US008955350B2

(12) United States Patent
Nuss

(10) Patent No.: US 8,955,350 B2
(45) Date of Patent: Feb. 17, 2015

(54) ICE DISPENSER WITH CRUSHER AND SHAVER FOR A REFRIGERATOR APPLIANCE

(75) Inventor: Bart Andrew Nuss, Fisherville, KY (US)

(73) Assignee: General Electric Company, Schenectady, NY (US)

( * ) Notice: Subject to any disclaimer, the term of this patent is extended or adjusted under 35 U.S.C. 154(b) by 460 days.

(21) Appl. No.: 13/475,440

(22) Filed: May 18, 2012

(65) Prior Publication Data

US 2013/0305763 A1 Nov. 21, 2013

(51) Int. Cl.
*F25C 5/02* (2006.01)

(52) U.S. Cl.
USPC ..... 62/320; 62/344

(58) Field of Classification Search
CPC ..... F25C 5/02; F25C 5/12; F25C 5/14; F25C 5/043; F25C 1/47; B02C 23/00
USPC ..... 62/320, 344; 222/80; 241/DIG. 17, 241/DIG. 27; 83/591–596
See application file for complete search history.

(56) References Cited

U.S. PATENT DOCUMENTS

| | | | | |
|---|---|---|---|---|
| 4,972,999 | A * | 11/1990 | Grace | 241/30 |
| 7,111,473 | B2 * | 9/2006 | Chung et al. | 62/320 |
| 7,278,275 | B2 * | 10/2007 | Voglewede et al. | 62/320 |
| 7,743,622 | B2 * | 6/2010 | Fischer et al. | 62/344 |
| 7,963,120 | B2 * | 6/2011 | An et al. | 62/344 |
| 2006/0059939 | A1 * | 3/2006 | An et al. | 62/344 |
| 2010/0200610 | A1 * | 8/2010 | Landers et al. | 222/1 |
| 2010/0218538 | A1 * | 9/2010 | Buchstab et al. | 62/320 |
| 2010/0251740 | A1 * | 10/2010 | Schmidt et al. | 62/320 |
| 2011/0138836 | A1 * | 6/2011 | Chase et al. | 62/320 |

* cited by examiner

*Primary Examiner* — Cassey D Bauer
*Assistant Examiner* — Kun Kai Ma
(74) *Attorney, Agent, or Firm* — Dority & Manning, P.A.

(57) ABSTRACT

An ice dispensing assembly that can provide whole, crushed, or shaved ice is described. Rotating blades are carried by a cylinder while locking blades are positioned on a shaft within the cylinder. The cylinder can rotate in different directions to provide whole ice or crushed ice. A control plate can be used to position a shaving blade so as to provide for shaved ice as well.

18 Claims, 11 Drawing Sheets

FIG. –1–

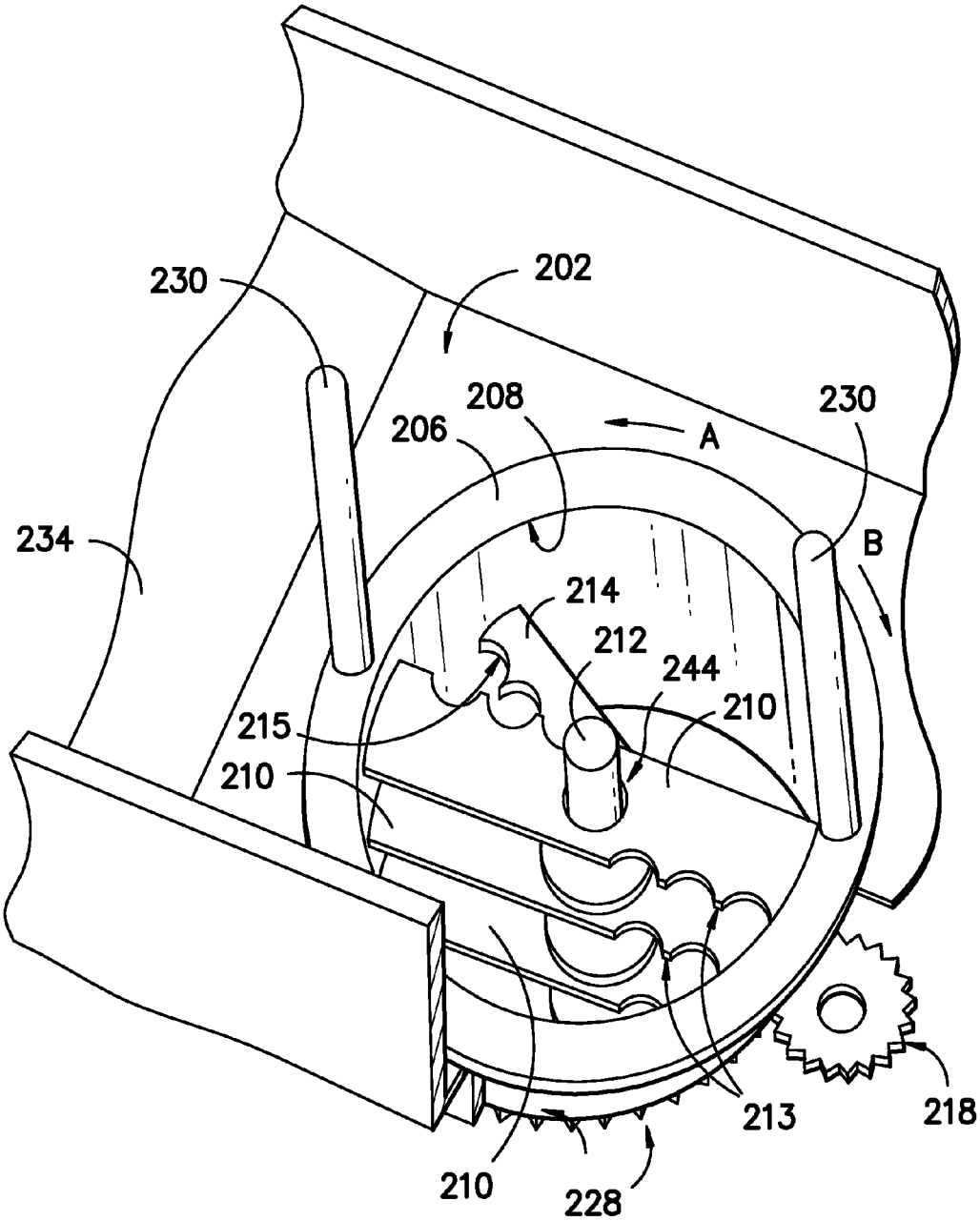
FIG. —4—

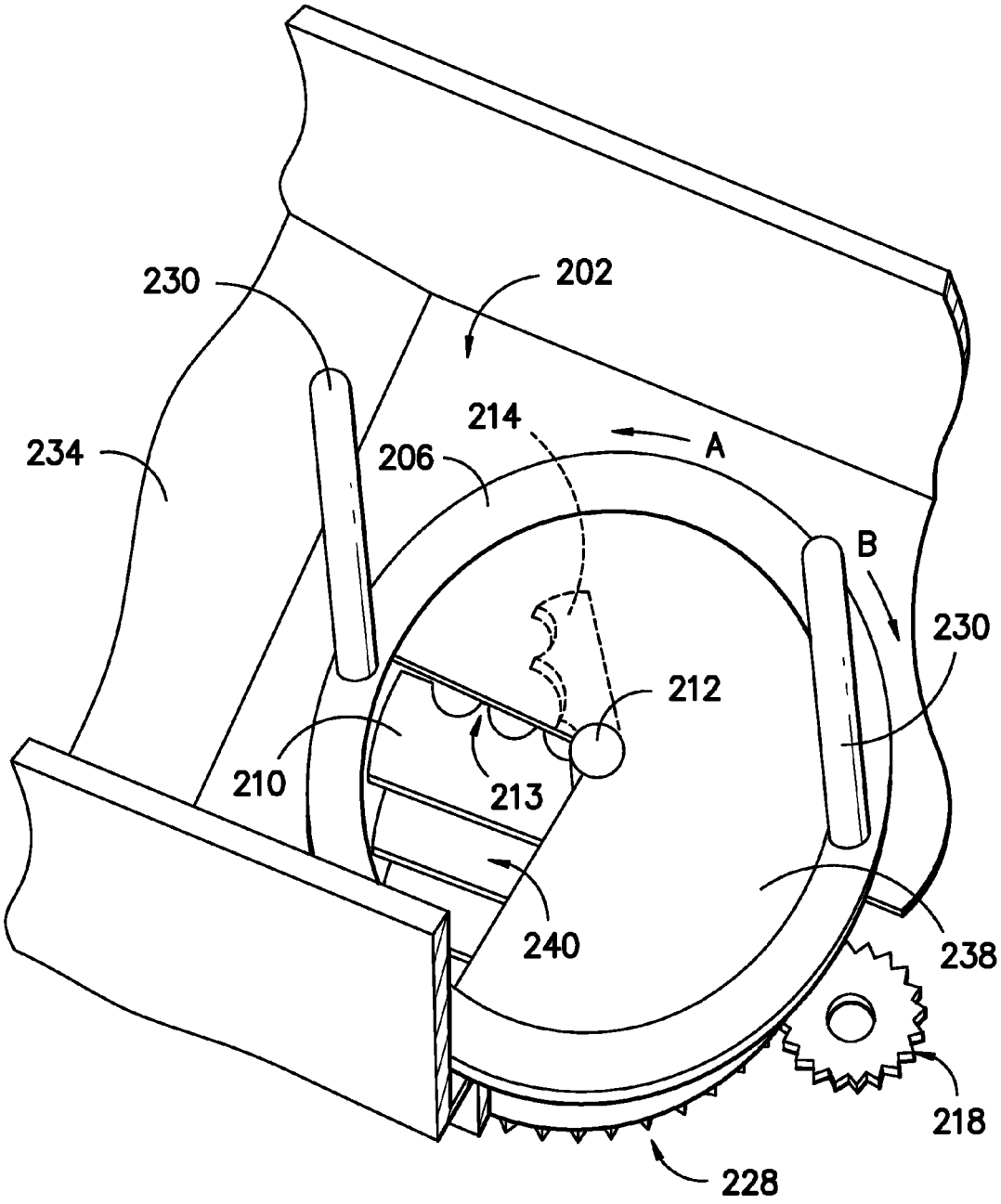
FIG. –5–

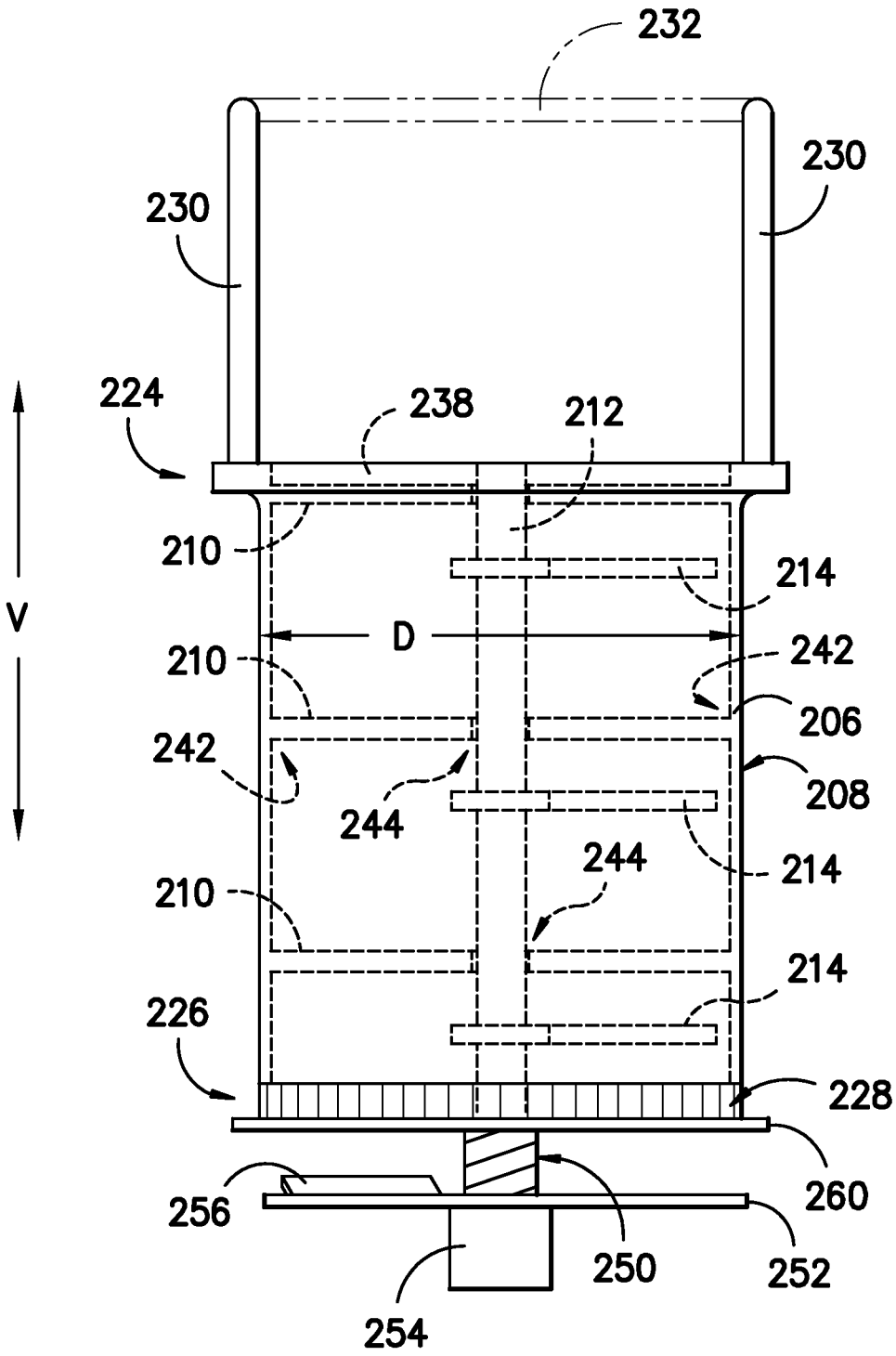
FIG. —6—

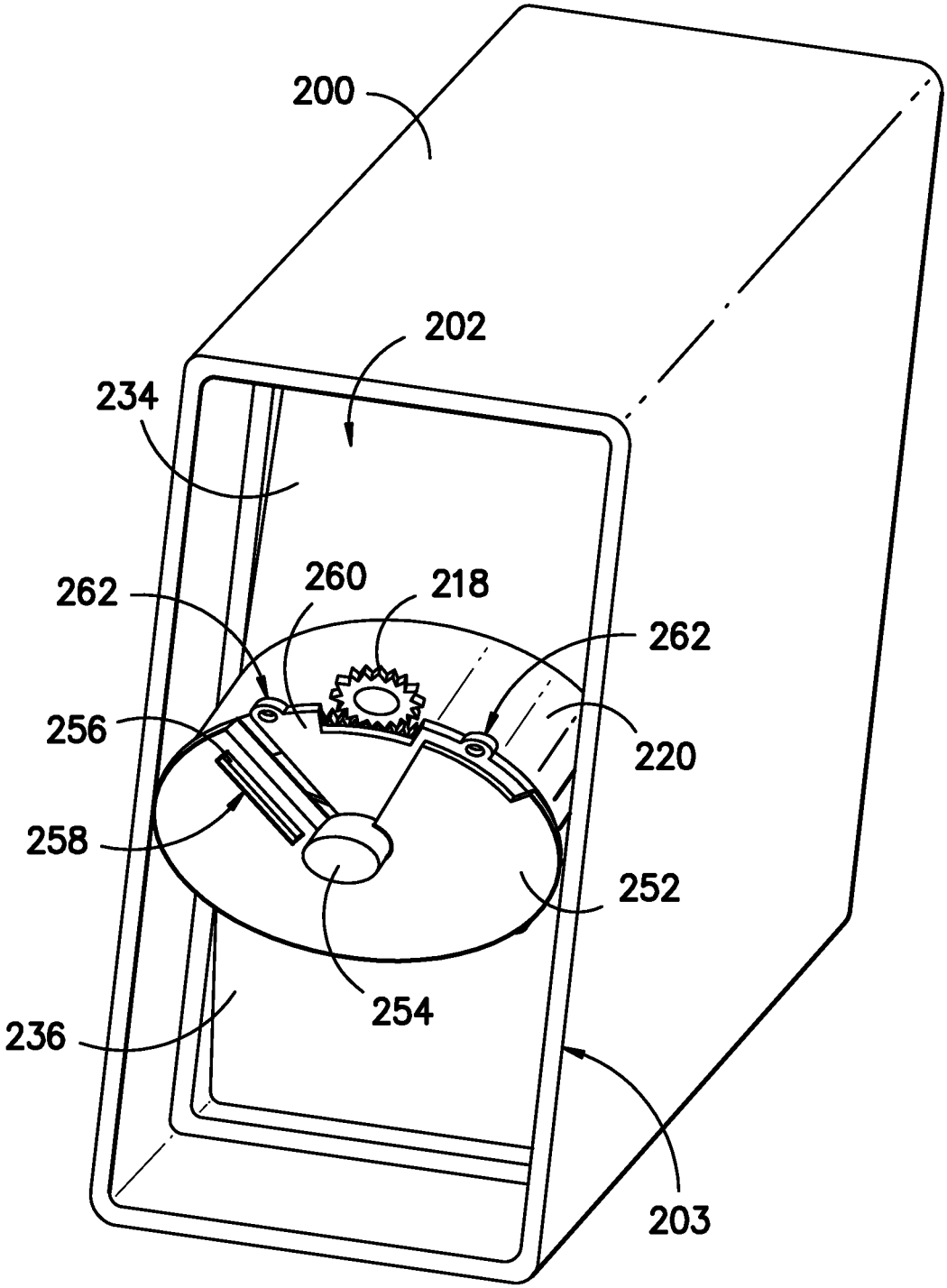
FIG. –7–

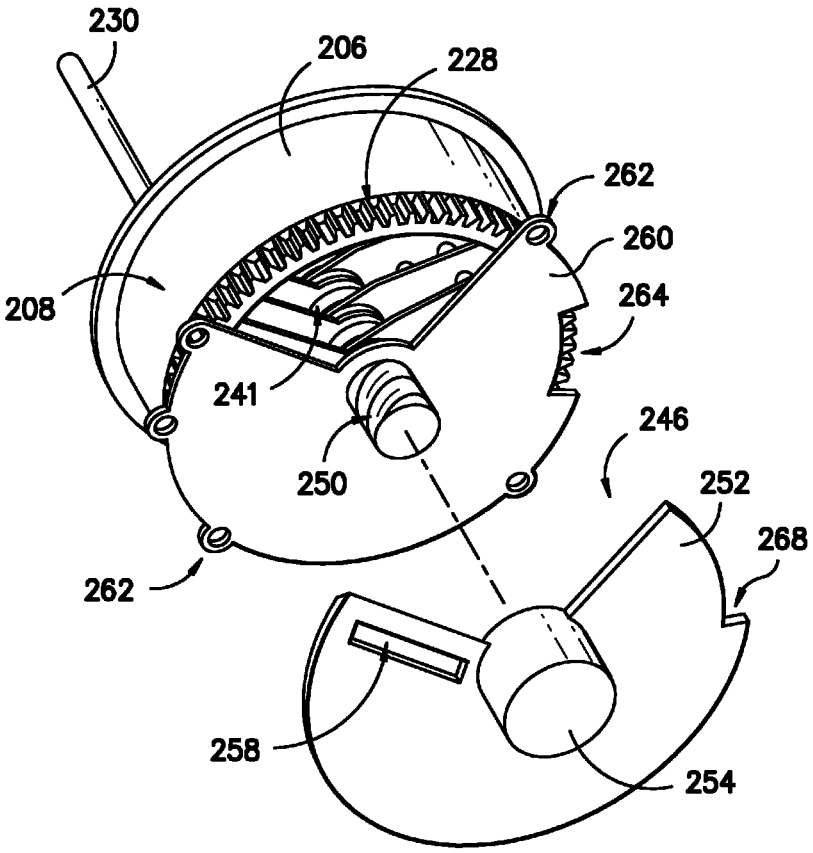
FIG. –8–

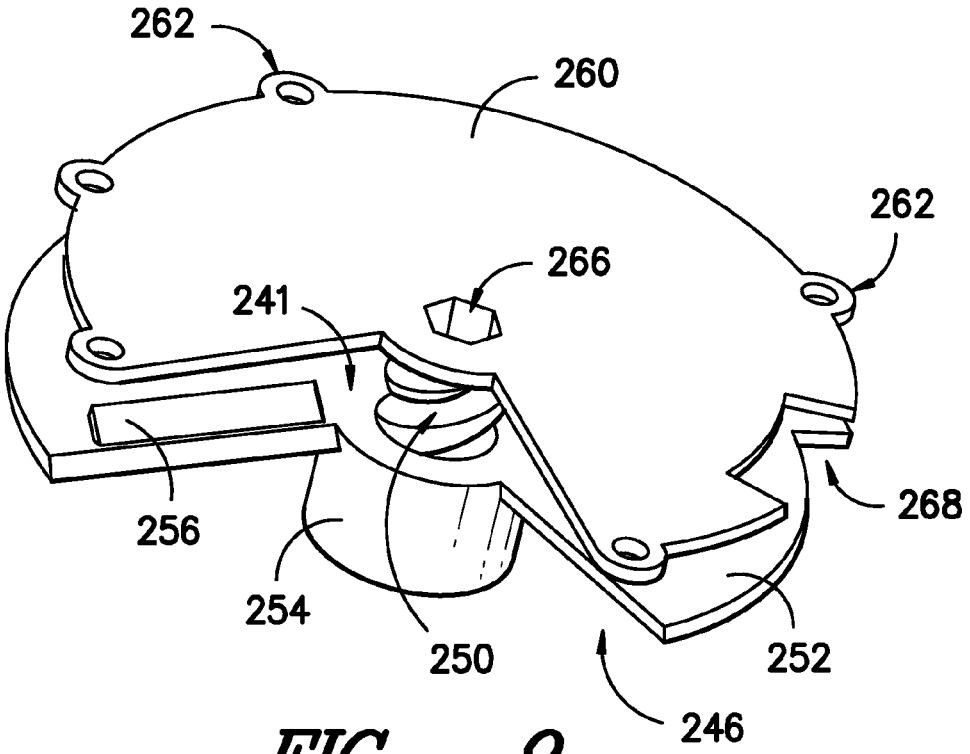
FIG. —9—
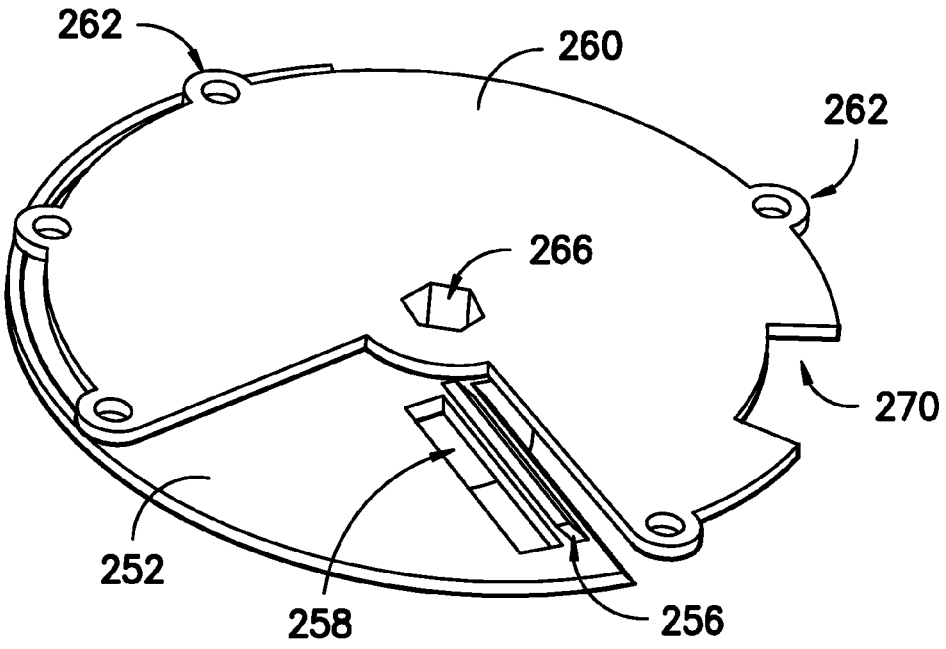
FIG. —10—

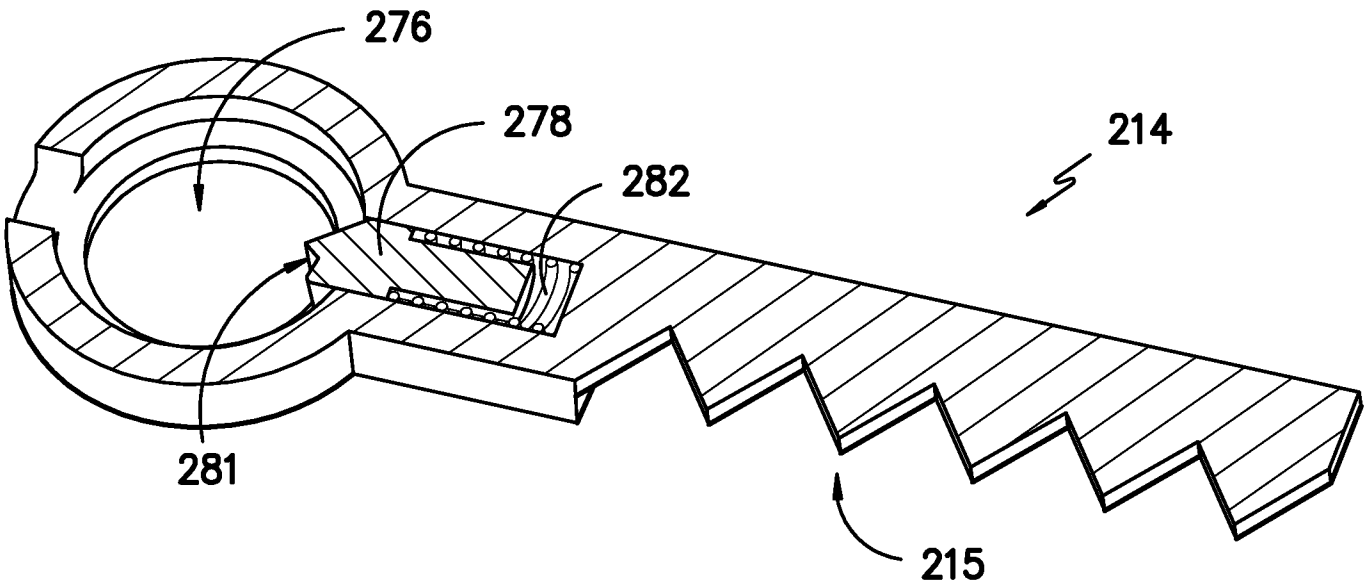
FIG. —11—

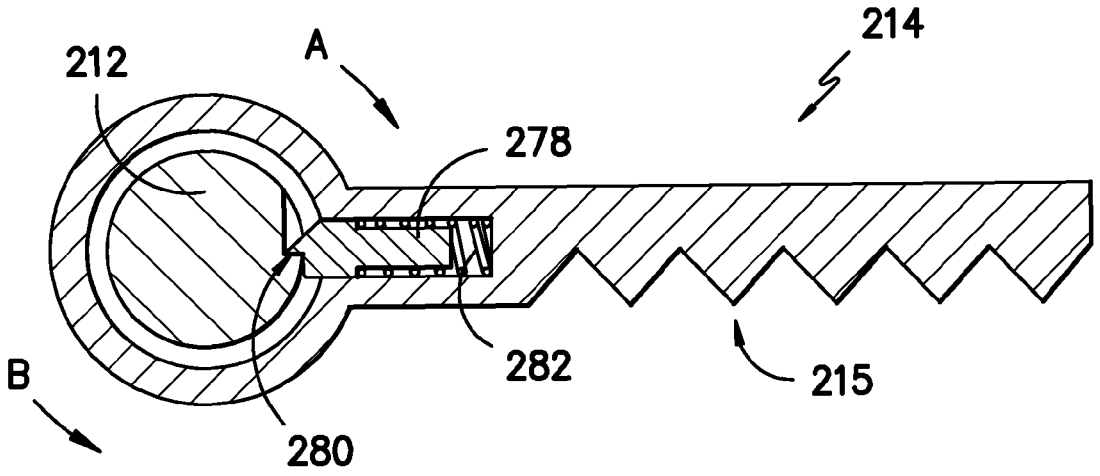
FIG. –12–
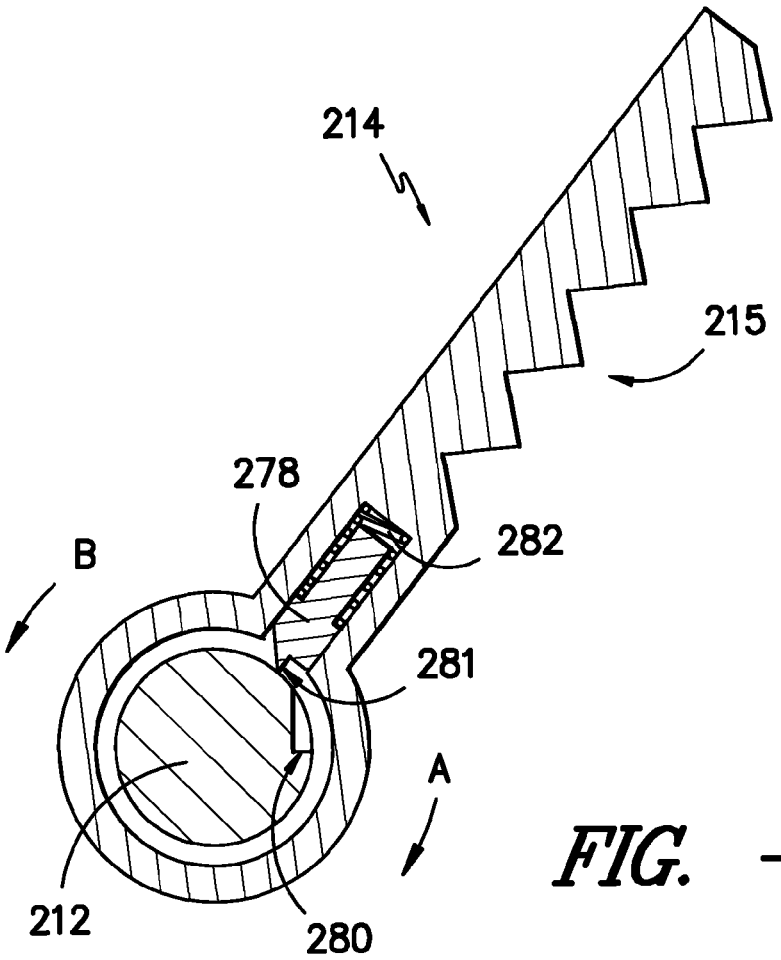
FIG. –13–

ICE DISPENSER WITH CRUSHER AND SHAVER FOR A REFRIGERATOR APPLIANCE

PRIORITY CLAIM

This application is a continuation-in-part application of and claims priority to U.S. patent application Ser. No. 13/285,122 filed on Oct. 31, 2011, which is incorporated herein by reference for all purposes.

FIELD OF THE INVENTION

The subject matter of the present disclosure relates to an ice dispenser for a refrigerator appliance and, more specifically, to an ice dispenser having an ice crusher and ice shaver.

BACKGROUND OF THE INVENTION

Generally, a refrigerator includes a freezer compartment and a fresh food compartment, which are partitioned from each other to store various foods at appropriate low temperatures. It is common to provide an automatic icemaker/water dispenser with a refrigerator. In a "side-by-side" type of refrigerator where the freezer compartment is arranged to the side of the fresh food compartment, the icemaker is usually disposed in the freezer compartment and, thus, utilizes the cold air in the freezer compartment, which typically includes an evaporator also disposed in the freezer compartment.

In a "bottom freezer" type of refrigerator where the freezer compartment is arranged beneath a top mounted fresh food compartment, convenience necessitates that the icemaker is disposed in a sub-compartment (often referred to as an "icebox") that is usually thermally insulated and configured in one of the top mounted fresh food compartment doors with ice delivered through an opening on the door. In such an arrangement, provision must be made for providing adequate refrigeration to the icebox to enable the icemaker to form and store the ice. An access door is commonly provided on the icebox to allow the consumer to access the internal ice bucket and icemaker.

Typically, the ice maker delivers ice into a storage container or bucket where the ice is kept until used. A panel on the front of the refrigerator allows the user to select between the dispensing of crushed ice or non-crushed ice. Conventionally, the ice is pushed by e.g., an auger through a chute or channel equipped with one or more blades, which are carried on a shaft and rotate with the shaft to contact and crush the ice. Chilled water can also be provided by routing a thermally conductive conduit to the panel such that the water is cooled before reaching the dispenser.

The ice container and dispenser can consume a significant amount of space from the freezer or fresh food compartment. Space is consumed not only by the volume required for ice creation and storage, but the mechanisms for moving and/or crushing the ice can also consume space the user might otherwise prefer to have available for food storage. Additionally, the mechanisms needed for crushing ice can also consume additional space. Depending upon how the components are positioned within these compartments, user access to portions of the compartment and/or to the ice storage container (e.g., for cleaning or manually collecting ice) can be inconvenient as well.

Accordingly, an ice dispensing system for a refrigerator appliance would be useful. More particularly, an ice dispensing system for a refrigerator appliance that can allow for the positioning of the ice storage container and/or ice crushing mechanism on a door of the refrigerator would be beneficial as it could provide savings in space. Additionally, such a system that can provide more convenient access to the refrigerator compartments and/or the ice storage container would be also be useful. Such an ice dispensing system that can provide whole ice, crushed ice, and/or shaved ice would also be particularly beneficial.

BRIEF DESCRIPTION OF THE INVENTION

The present invention provides an ice dispensing assembly that can provide whole, crushed, or shaved ice. Rotating blades are carried by a cylinder while locking blades are positioned in a shaft within the cylinder. The cylinder can rotate in different directions to provide whole ice or crushed ice. A control plate can be used to position a shaving blade so as to provide for shaved ice as well. Additional aspects and advantages of the invention will be set forth in part in the following description, or may be apparent from the description, or may be learned through practice of the invention.

In one exemplary embodiment, the present invention provides an ice dispensing assembly for an appliance. The assembly includes a container for the receipt of ice. The container has a bottom defining an opening for the passage of ice from the container. A cylindrically-shaped sleeve is connected with the opening at the bottom of the container and extends from the bottom of the container. A base is connected with the sleeve. A cylinder is positioned at least partially within the sleeve and is rotatable with respect to the sleeve and the base. The cylinder has a wall and defines an inner diameter. At least one rotatable blade is carried by the cylinder and extends along the inner diameter between opposing ends positioned at the wall of the cylinder. The at least one rotatable blade defines a guide hole that is centrally positioned along the at least one rotatable blade. A shaft extends into the cylinder and through the guide hole of the at least one rotatable blade. The shaft has a bottom end connected to the base. At least one locking blade is carried upon the shaft. The at least one locking blade is configured to rotate in a first direction about the shaft and is configured to lock into a fixed position when rotated in an opposite, second direction about the shaft.

A metering plate is attached to the shaft and positioned proximate to the opening at the bottom of the container. The metering plate defines a first aperture for the passage of ice from the container, through the opening in the bottom of the container, and into the sleeve. A control plate is positioned proximate to the base. A shaving blade is carried upon the control plate. The base defines a second aperture for the passage of ice from the cylinder. The control plate defines a third aperture. The control plate is configured for movement between a first position where the second aperture and third aperture are aligned and a second position where the second aperture is blocked by the control plate and the shaving blade is positioned adjacent to the second aperture.

In another exemplary embodiment, the present invention provides a refrigerator that includes a cabinet and a fresh food compartment, a freezer compartment, or both. An ice maker and an ice dispensing assembly are provided. The ice dispensing assembly includes a container for the receipt of ice. The container has a bottom defining an opening for the passage of ice from the container. A cylindrically-shaped sleeve is connected with the opening at the bottom of the container and extends from the bottom of the container. A base is connected with the sleeve. A cylinder is positioned at least partially within the sleeve and is rotatable with respect to the sleeve and the base. The cylinder has a wall and defines an inner diameter. At least one rotatable blade is carried by the cylinder and extends along the inner diameter between opposing ends positioned at the wall of the cylinder. The at least one rotatable blade defines a guide hole that is centrally positioned along the at least one rotatable blade. A shaft extends into the cylinder and through the guide hole of the at least one rotatable blade. The shaft has a bottom end connected to the base. At least one locking blade is carried upon the shaft. The at least one locking blade is configured to rotate in a first direction about the shaft and is configured to lock into a fixed position when rotated in an opposite, second direction about the shaft.

A metering plate attached to the shaft and positioned proximate to the opening at the bottom of the container. The metering plate defines a first aperture for the passage of ice from the container, through the opening in the bottom of the container, and into the sleeve. A control plate is positioned proximate to the base. A shaving blade is carried upon the control plate. The base defines a second aperture for the passage of ice from the cylinder. The control plate defines a third aperture. The control plate is configured for movement between a first position where the second aperture and third aperture are aligned and a second position where the second aperture is blocked by the control plate and the shaving blade is positioned adjacent to the second aperture.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 4 illustrates the interior of the exemplary ice storage container of FIG. 3, including a top down view of an exemplary embodiment of a rotating cylinder or drum for the processing of ice. A metering plate and a portion of the storage container is removed for purposes of more clearly describing the present invention.

FIG. 5 is another view of the interior of the exemplary ice storage container taken from the same perspective as FIG. 4 with an exemplary metering plate in position.

A cross-sectional view of the exemplary cylinder or drum of FIG. 4 is shown in FIG. 6.

Figure 3:
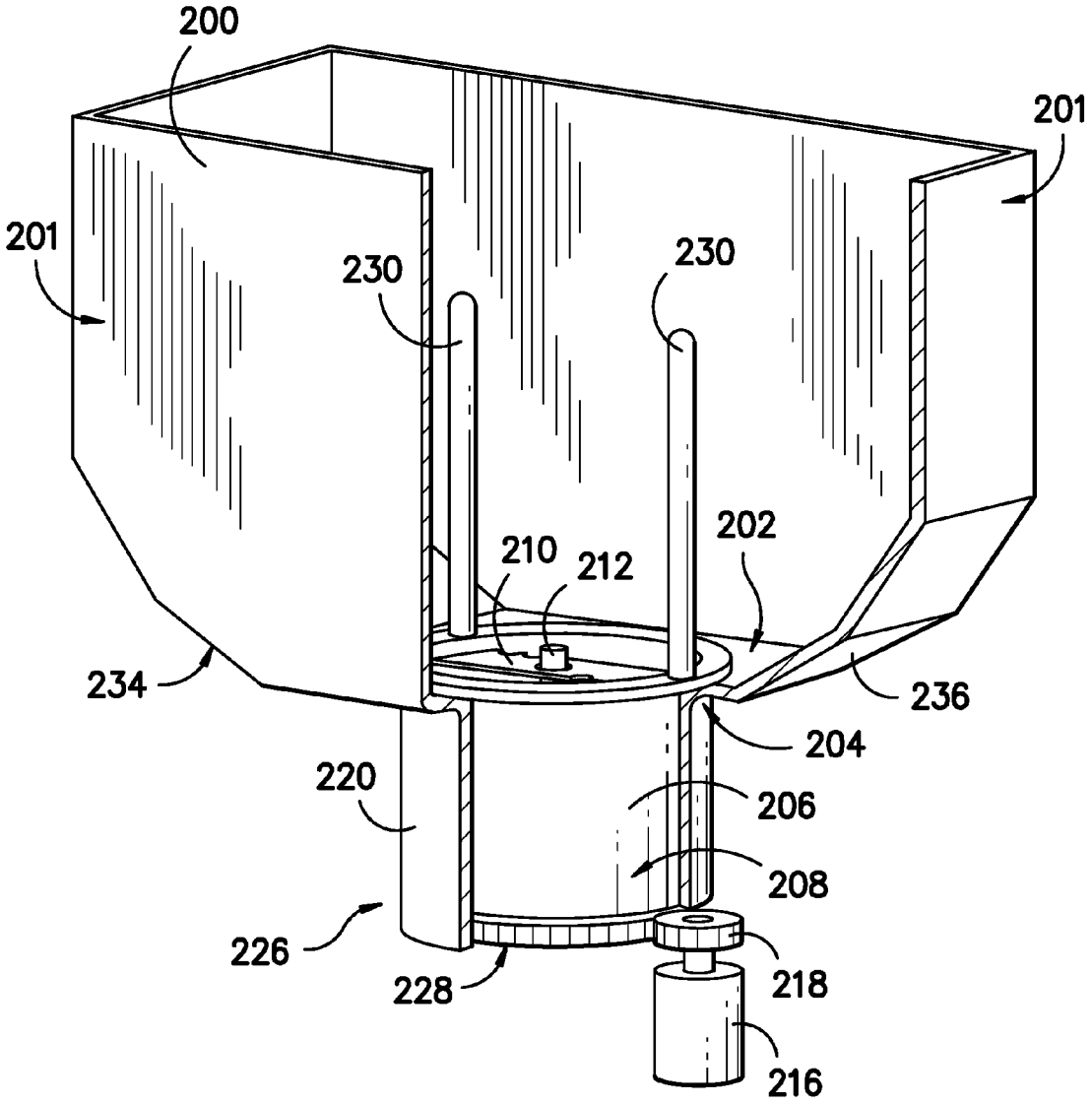
FIG. 3 depicts a perspective view of an ice storage container and crusher in an exemplary embodiment of an ice dispensing assembly of the present invention. For purposes of revealing interior components in this view, a portion of the storage container is removed.

FIG. 7 is a bottom view of the exemplary ice storage container of FIG. 3.

FIG. 8 is an exploded view of the bottom of an exemplary cylinder, base, and rotatable control plate.

FIG. 9 is a perspective view of an exemplary base and control plate of the present invention. The control plate is shown in the open position in FIG. 9 (also referred to herein as the first position) and shown in a closed position in FIG. 10 (also referred to herein as the second position).

FIGS. 11-13 illustrate cross-sectional views of exemplary embodiments of a locking blade of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 1:
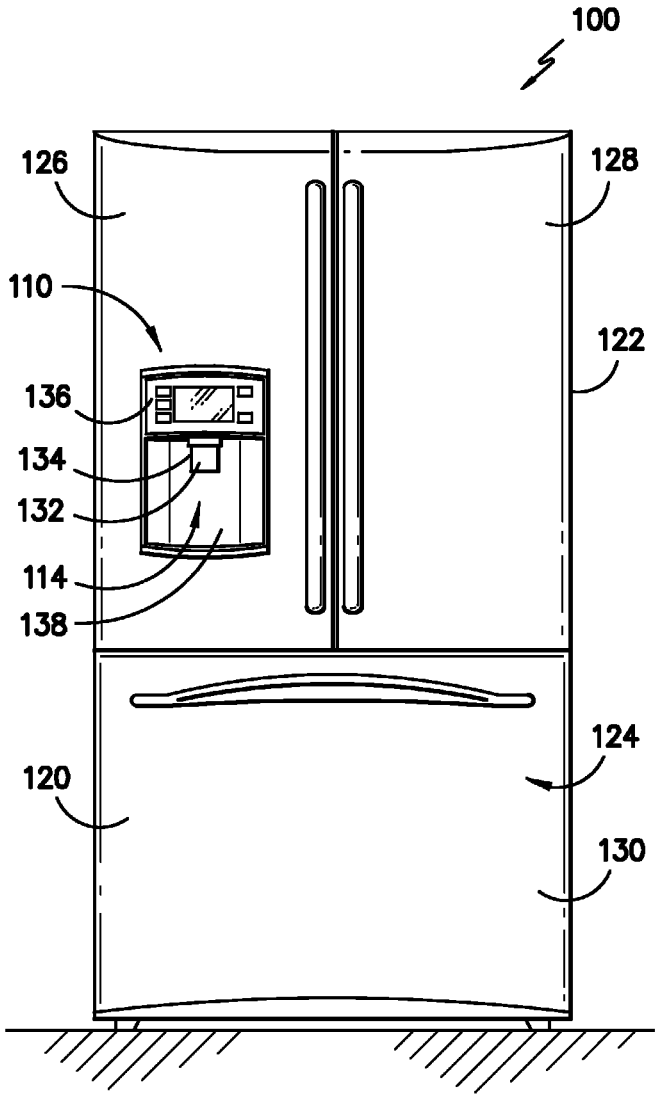
FIG. 1 illustrates an exemplary embodiment of a refrigerator appliance as may be used with the present invention.

FIG. 1 is a front view of a refrigerator 100 including an ice-dispensing assembly 110 for dispensing water and/or ice. In this exemplary embodiment, ice-dispensing assembly 110 includes a dispenser 114 positioned on an exterior portion of refrigerator 100. Refrigerator 100 includes a cabinet 120 having an upper fresh food compartment 122 and a lower freezer compartment 124 arranged at the bottom of refrigerator 100. As such, refrigerator 100 is generally referred to as a bottom mount refrigerator. In the exemplary embodiment, cabinet 120 also defines a mechanical compartment (not shown) for receipt of a sealed cooling system. Using the teachings disclosed herein, one of skill in the art will understand that the present invention can be used with other types of refrigerators (e.g., side-by-sides) as well. Consequently, the description set forth herein is for illustrative purposes only and is not intended to limit the invention in any aspect.

Refrigerator doors 126, 128 are rotatably hinged to an edge of cabinet 120 for accessing fresh food compartment 122. A freezer door 130 is arranged below refrigerator doors 126, 128 for accessing freezer compartment 124. In the exemplary embodiment, freezer door 130 is coupled to a freezer drawer (not shown) slidably coupled within freezer compartment 124.

For this exemplary embodiment, dispenser 114 includes a discharging outlet 132 for accessing ice and water. A single paddle 134 is mounted below discharging outlet 132 for operating dispenser 114. A user interface panel 136 is provided for controlling the mode of operation. For example, user interface panel 136 includes a water dispensing button (not labeled) and an ice-dispensing button (not labeled) for selecting a desired mode of operation such as crushed or non-crushed ice.

Discharging outlet 132 and paddle 134 are an external part of dispenser 114, and are mounted in a concave portion 138 defined in an outside surface of refrigerator door 126. Concave portion 138 is positioned at a predetermined elevation convenient for a user to access ice or water enabling the user to access ice without the need to bend-over and without the need to access freezer compartment 124. In the exemplary embodiment, concave portion 138 is positioned at a level that approximates the chest level of a user.

Figure 2:
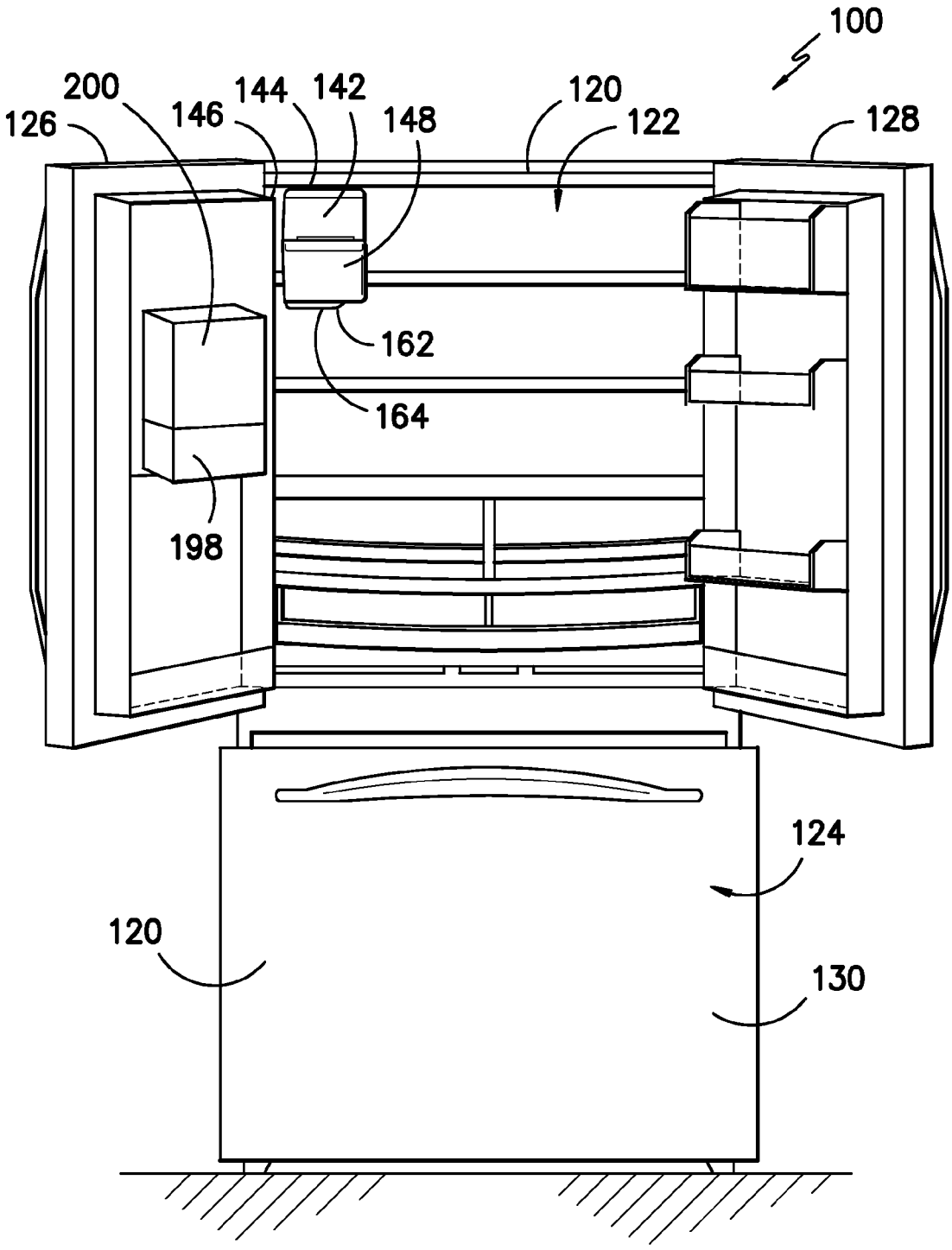
FIG. 2 provides another illustration of the exemplary embodiment of FIG. 1 with doors to the fresh food compartment shown in an open position.

FIG. 2 is a perspective view of refrigerator 100 having doors 126, 128 in an open position to reveal the interior of the fresh food compartment 122. As such, certain components of this exemplary embodiment of the ice dispensing assembly 110 are illustrated. Ice dispensing assembly 110 includes an insulated housing 142 mounted within refrigerator compartment 122 along an upper surface 144 of compartment 122 and along a sidewall 146 of compartment 122. Insulated housing 142 includes insulated walls 148 defining an insulated cavity (not shown). Due to the insulation which encloses the cavity, the temperature within the cavity can be maintained at levels different from the temperature in the surrounding fresh food compartment 122.

In this exemplary embodiment, the insulated cavity is constructed and arranged to operate at a temperature that facilitates producing and storing ice. More particularly, the insulated cavity contains an ice maker for creating ice and feeding the same to a container 200 that is removably carried by a platform 198 mounted on refrigerator door 126. As illustrated in FIG. 2, container 200 is placed at a vertical position on refrigerator door 126 that will allow for the receipt of ice from a discharge opening 162 located along a bottom edge 164 of insulated housing 142. As door 126 is closed or opened, container 200 is moved in and out of position under insulated housing 142. Alternatively, in another exemplary embodiment of the present invention, insulated housing 142 and its ice maker can be positioned directly on door 126. In still another embodiment of the present invention, in a configuration where the fresh food compartment and the freezer compartment are located side by side (as opposed to over and under as shown in FIGS. 1 and 2), the ice maker could be located on the door for the freezer compartment and directly over container 200. As such, the use of an insulated housing would be unnecessary. Other configurations for the location of ice container 200, an ice maker, and/or insulated housing 142 may be used as well.

Operation of the refrigerator 100 can be regulated by a controller (not shown) that is operatively coupled to user interface panel 136 and/or paddle 134. Panel 136 provides selections for user manipulation of the operation of refrigerator 100 such as e.g., selections between whole, crushed, or shaved ice, chilled water, and/or other options as well. In response to user manipulation of the user interface panel 136, the controller operates various components of the refrigerator 100. The controller may include a memory and one or more microprocessors, CPUs or the like, such as general or special purpose microprocessors operable to execute programming instructions or micro-control code associated with operation of refrigerator 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout refrigerator 100. In the illustrated embodiment, the controller may be located within the control panel area of door 126. In such an embodiment, input/output ("I/O") signals may be routed between the controller and various operational components of refrigerator 100 such as a motor for rotating components of an ice crusher as will be described further below. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller via one or more signal lines or shared communication busses.

An exemplary embodiment of the ice storage container 200 along with an ice crushing and shaving mechanism as may be used with ice dispensing assembly 110 is further illustrated in FIG. 3. For purposes of revealing internal components in this view, a portion of the storage container 200 is removed including skirt 203 (FIG. 7) and portions of container walls 201. Container 200 has a bottom 202 that defines an opening 204. FIG. 4 illustrates a close up view of bottom 202 with a portion of storage container 200 removed for purposes of revealing internal components. FIG. 5 reveals the same close-up view as FIG. 4 except that an ice metering plate 238 with a first aperture 240 is shown in position. Ice (not shown) can pass from container 200, through opening 204, through first aperture 240 in metering plate 238, and into a drum or rotatable cylinder 206. Bottom 202 includes sloped walls 234 and 236 that are sloped towards opening 204 to help direct ice towards cylinder 206.

The amount of ice delivered into cylinder 206 from container 200 is controlled by a metering plate 238. As best shown in FIGS. 5 and 6, metering plate 238 is attached to a fixed shaft 212 and does not rotate with cylinder 206. Metering plate 238 defines the first aperture 240 through which ice must pass in order to move through cylinder 206. As such, first aperture 240 can be sized to provide the desired flow rate of ice from container 200. Teeth can be positioned along an edge of the aperture of metering plate 238 to help break up ice as cylinder 206 rotates so as to prevent jams.

As seen in the cross-sectional side view in FIG. 6, rotatable cylinder 206 has an outer cylindrical wall 208 and an inner diameter D. Referring now to FIGS. 3 through 6, multiple rotatable blades 210 extend along inner diameter D between opposing ends 242 positioned at wall 208 and carried by cylinder 206. Blades 210 each have a first plurality of teeth 213. Although multiple rotatable blades 210 are shown, one or more such blades may be used. Each rotatable blade 210 defines a guide hole 244 through which a shaft 212 extends. Rotatable blades 210 rotate with drum 206 as it rotates about shaft 212, which is located in the middle of cylinder 206. Although fixed shaft 212 extends into drum 206, shaft 212 is not connected with rotatable blades 210, which can freely rotate about shaft 212 in either a clockwise or counter-clockwise direction.

Multiple locking blades 214 are carried upon fixed shaft 212. Blades 214 each have second plurality of teeth 215. Although multiple locking blades 214 are shown, one or more such blades may be used. Each locking blade 214 is configured to rotate completely around shaft 212 (i.e. a full 360 degrees) in a first direction designated with arrow A in FIG. 4. Conversely, if rotated in a second direction designated with arrow B, locking blades 214 will eventually lock into a fixed position on shaft 212.

Referring now to FIGS. 11-13, an exemplary embodiment of locking blades 214 is illustrated. Locking blade 214 includes an opening 276 into which shaft 212 is received. A plunger 278 is carried by locking blade 214 and is biased or pressed toward shaft 212 by a compressed spring 282. When rotated in the first direction (arrow A), locking blade 214 can rotate completely around shaft 212. Conversely, when rotated in the second direction (arrow B), a locking surface 281 on plunger 278 eventually contacts a notch 280 on shaft 212 and stops the rotation of locking blade 214 in order to fix its position as shown in FIG. 12. However, locking blade 214 can be released by moving again in the direction of arrow A.

As best viewed in FIGS. 3 and 7, a cylindrically-shaped sleeve 220 is positioned around the opening 204 and extends from bottom 202 of container 200. Sleeve 220 at least partially encloses rotatable cylinder 206, which rotates within sleeve 220. A base 260 is positioned at the bottom of sleeve 220 and can be connected to sleeve 220 or container 200 using apertures 262. In alternative embodiments, base 260 may be integrally formed with sleeve 220. Regardless, base 260 is fixed in position at the bottom of sleeve 220 and does not rotate with cylinder 206. As shown in FIGS. 8 and 9, base 260 defines a second aperture 241 through which ice may exit sleeve 220. Base 260 also defines a hexagonally-shaped hole 266 into which an end of shaft 212 can be fixed.

Referring to FIGS. 6 through 9, a control plate 252 is positioned proximate to base 260. For this exemplary embodiment, control plate 252 is rotatable between a first position shown in FIG. 9 and a second position shown in FIG. 10. In the first position shown in FIG. 9, a third aperture 246 defined by control plate 252 is aligned with second aperture 241 of base 260. In the second position shown in FIG. 10, the third aperture defined by control plate 252 is not aligned with second aperture 241 and, instead, blocks second aperture 241. Additionally, in the second position shown in FIG. 10, a shaving blade 256 has been positioned at second aperture 241 for the purposes of shaving ice as will be further described. Blade 256 is positioned near a slot 258 in control plate 252 through which shaved ice may pass from cylinder 206.

As shown in FIGS. 6, 8, 9, and 10, control plate 252 is positioned upon a threaded shaft 250 that is aligned with fixed shaft 212 and received into pilot 254. The high lead threads of shaft 250 serve to raise and lower control plate 252 along vertical direction V (FIG. 6) as control plate 252 is rotated between the first position shown in FIG. 9 and the second position shown in FIG. 10. By way of example, a solenoid or other device may be connected with control plate 252 to rotate it between the first and second positions. Control plate 252 is provided by way of example only and other configurations for control plate 252 may be used as well. For example, control plate 252 could be slid linearly in and out of a position that blocks second aperture 241 rather than being rotated.

As shown in FIG. 6, rotatable cylinder 206 extends between a top end 224 and a bottom end 226. At the top end, cylinder 206 includes a pair of tines 230 that extend into container 200 along vertical direction V. As cylinder 206 is rotated, tines 230 stir ice in container 200 to help the ice flow into cylinder 206. Although a pair of tines 230 are shown, a single tine may be used. Multiple other shapes and configurations may also be used to provide for the stirring of ice in container 200. For example, tine 230 may be connected by an extension or bridge 232. Tine 230 may also be shaped as bars rather than rods. Additionally, tines 230 may form part of a single, unitary piece that includes rotatable blades 210. As such, tines 230 and blades 210 can be assembled by sliding the same along slots or recesses formed in the wall 208 of cylinder 206. Other configurations may be used as well.

Referring to FIGS. 5 through 8, the second end 226 of cylinder 206 includes a first plurality of gear teeth 228 extending circumferentially about cylinder 206 as shown. Teeth 228 are connected with a second plurality of gear teeth 218 driven by motor 216. A slot 268 in control plate 252 and a slot 264 in base 260 provide for connection between teeth 218 and 228 (FIGS. 8 through 10). Motor 216 can be selectively operated by e.g., a controller, so as to rotate cylinder 206 in either direction A or direction B.

By way of example of the operation of ice dispensing assembly 110, ice is dropped into container 200 from the ice maker through opening 162 in insulated housing 142. The sloped walls 234 and 236 of bottom 202 direct ice towards first opening 204 so that ice may move through first aperture 240 in metering plate 238 and into cylinder 206 under the force of gravity. The rotation of cylinder 206 helps stir the ice and facilitate movement as tines 230 will move ice near bottom 202.

Depending upon whether the user has selected shaved, crushed, or whole ice using interface panel 136, the controller can determine the direction of rotation of cylinder 206 by powering motor 216 in the appropriate direction. Such rotation could be activated based upon e.g., the depressing of paddle 134 by a user such that a request for ice is received by the controller. The controller could then activate motor 216 in the proper direction for shaved, crushed, or whole ice.

If the user has selected whole or non-crushed ice, cylinder 206 is rotated in the direction of arrow A (FIG. 4) so that the movement of rotatable blades 210 relative to locking blades 214 will avoid crushing ice therebetween. As previously indicated, locking blades 214 are completely rotatable in the direction of arrow A. Additionally, for the selection of non-crushed ice, control plate 252 is placed into the first position shown in FIG. 9 where third aperture 246 and second aperture 241 are aligned. As cylinder 206 rotates, whole ice may fall under the force of gravity from container 200, through opening 202 and first aperture 240, through sleeve 220, and exit through the second aperture 241 and third aperture 246.

Should the user select shaved ice, cylinder 206 is still rotated in the direction of arrow A. However, control plate 252 is placed into the second position shown in FIG. 10 so that shaving blade 256 is not present in second aperture 241. Accordingly, as cylinder 206 rotates in the direction of arrow A, rotatable blades 210 force ice from container 200 against blade 256. The resulting ice shavings can exit sleeve 220 through slot 258.

Alternatively, if the user selects crushed ice, control plate 252 is placed into the first position shown in FIG. 9. Motor 216 is now operated to rotate cylinder 206 in the direction of arrow B (FIGS. 4 and 5). Ice (stirred by tines 230) will eventually be pushed by rotating blades 210 in cylinder 206. Depending upon their initial position, locking blades 214 may rotate a small distance (due to contact with the ice moved by blade 210) until blades 214 are locked in a position fixed by plunger 278 as discussed above. Ice will now be crushed between the first plurality of teeth 213 on rotatable blade 210 and the second plurality of teeth 215 on locking blades 214. The crushed ice may exit cylinder 206 through the aligned second aperture 241 and third aperture 246.

In each case, after travelling down sleeve cylinder 206, shaved, crushed or whole ice can exit sleeve 220 and pass through discharge outlet 132 into e.g., the user's cup or glass. The directions of rotation shown in the figures for cylinder 206 and control plate 252 are by way of example only. Directions opposite to that shown in the figures may also be used with different blade configurations as will be understood using the teachings disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice dispensing assembly for an appliance, comprising:

a container for the receipt of ice, said container having a bottom defining an opening for the passage of ice from said container;

a cylindrically-shaped sleeve connected with the opening at the bottom of said container and extending from the bottom of said container;

a base connected with said sleeve;

a cylinder positioned at least partially within said sleeve and rotatable with respect to said sleeve and said base, said cylinder having a wall and defining an inner diameter;

at least one rotatable blade carried by said cylinder and extending along the inner diameter between opposing ends positioned at the wall of said cylinder, said at least one rotatable blade defining a guide hole that is centrally positioned along said at least one rotatable blade;

a shaft extending into said cylinder and through the guide hole of said at least one rotatable blade, said shaft having a bottom end connected to said base;

at least one locking blade carried upon said shaft, said at least one locking blade configured to rotate in a first direction about said shaft and configured to lock into a fixed position when rotated in an opposite, second direction about said shaft;

a plunger received within said at least one locking blade and biased toward said shaft, said plunger having a locking surface;

wherein said shaft defines a notch for receipt of the locking surface of said plunger when said locking blade is rotated in the second direction;

a metering plate attached to said shaft and positioned proximate to the opening at the bottom of said container, said metering plate defining a first aperture for the passage of ice from said container, through the opening in the bottom of said container, and into said sleeve;

a control plate positioned proximate to said base; and a shaving blade carried upon said control plate;

wherein said base defines a second aperture for the passage of ice from said cylinder and wherein said control plate defines a third aperture;

wherein said control plate is configured for movement between a first position where the second aperture and third aperture are aligned and a second position where the second aperture is blocked by said control plate and said shaving blade is positioned adjacent to said second aperture.

2. An ice dispensing assembly for an appliance as in claim 1, further comprising:

a threaded shaft extending from said base and to which said control plate is rotatably connected such that said control plate is rotatable between the first position and the second position, said threads configured for lifting or lowering said control plate depending upon the direction of rotation of said control plate.

3. An ice dispensing assembly for an appliance as in claim 1, wherein said control plate defines a slot next to said shaving blade for the movement of shaved ice therethrough.

4. An ice dispensing assembly for an appliance as in claim 1, wherein said rotatable blade includes a first plurality of teeth and said locking blade carries a second plurality of teeth, and wherein said first and second plurality of teeth are oriented to crush ice therebetween when said rotatable blade is locked into the fixed position.

5. An ice dispensing assembly for an appliance as in claim 1, wherein said cylinder has a top end and a bottom end, and wherein the bottom end is configured with a first plurality of gear teeth extending circumferentially about said cylinder.

6. An ice dispensing assembly for an appliance as in claim 5, further comprising:

a motor having a second plurality of gear teeth in mechanical communication with said first plurality of gear teeth of said cylinder, said motor configured for rotating said cylinder in either the first direction or the second direction.

7. An ice dispensing assembly for an appliance as in claim 1, wherein said rotatable cylinder has a top end and a bottom end, and further comprising at least one tine extending from the top end of said cylinder into said container.

8. An ice dispensing assembly for an appliance as in claim 1, further comprising:

a metering plate attached to said shaft, said metering plate having an outer diameter slightly less than the inner diameter of said cylinder, said metering plate defining an aperture with teeth along at least one edge of the aperture that are configured for breaking ice.

9. An ice dispensing assembly for an appliance as in claim 1, wherein the bottom of said container is sloped towards the opening defined by the bottom.

10. An ice dispensing assembly for an appliance as in claim 1, wherein said at least one rotatable blade comprises a plurality of rotating blades.

11. An ice dispensing assembly for an appliance as in claim 1, wherein said at least one locking blade comprises a plurality of locking blades.

12. A refrigerator, comprising:

a cabinet;

a flesh food compartment, a freezer compartment, or both;

an ice maker;

an ice dispensing assembly, comprising:

a container for the receipt of ice, said container having a bottom defining an opening for the passage of ice from said container;

a sleeve connected with the opening at the bottom of said container and extending from the bottom of said container;

a base connected with said sleeve;

a cylinder positioned at least partially within said sleeve and rotatable with respect to said sleeve and said base, said cylinder having a wall and defining an inner diameter;

at least one rotatable blade carried by said cylinder and extending along the inner diameter between opposing ends positioned at the wall of said cylinder, said at least one rotatable blade defining a guide hole that is centrally positioned along said at least one rotatable blade;

a shaft extending into said cylinder and through the guide hole of said at least one rotatable blade, said shaft having a bottom end connected to said base;

at least one locking blade carried upon said shaft, said at least one locking blade configured to rotate in a first direction about said shaft and configured to lock into a fixed position when rotated in an opposite, second direction about said shaft;

a plunger carried by said locking blade and biased toward said shaft, said plunger having a locking surface;

wherein said shaft defines a notch for receipt of the locking surface of said plunger when said locking blade is rotated in the second direction;

a metering plate attached to said shaft and positioned proximate to the opening at the bottom of said container, said metering plate defining a first aperture for the passage of ice from said container, through the opening in the bottom of said container, and into said sleeve;

a control plate positioned proximate to said base; and a shaving blade carried upon said control plate;

wherein said base defines a second aperture for the passage of ice from said cylinder and wherein said control plate defines a third aperture;

wherein said control plate is configured for movement between a first position where the second aperture and third aperture are aligned and a second position where the second aperture is blocked by said control plate and said shaving blade is positioned adjacent to said second aperture.

13. A refrigerator as in claim 12, further comprising:

a threaded shaft extending from said base and to which said control plate is rotatably connected such that said control plate raises or lowers depending upon the direction said control plate is rotated about said threaded shaft.

14. A refrigerator as in claim 12, wherein said control plate defines a slot near said shaving blade for the movement of shaved ice therethrough.

15. A refrigerator as in claim 12, wherein said rotatable blade includes a first plurality of teeth and said locking blade carries a second plurality of teeth, and wherein said first and second plurality of teeth are positioned to crush ice when said rotatable blade is rotated in the second direction.

16. A refrigerator as in claim 12, wherein said cylinder has a top end and a bottom end, and wherein the bottom end is configured with a first plurality of gear teeth extending circumferentially about said cylinder.

17. A refrigerator as in claim 16, further comprising:

a motor having a second plurality of gear teeth in mechanical communication with said first plurality of gear teeth of said cylinder, said motor configured for rotating said cylinder in either the first direction or the second direction.

18. A refrigerator as in claim 12, wherein said rotatable cylinder has a top end and a bottom end, and further comprising at least one tine extending from the top end of said cylinder into said container.

* * * * *